United States Patent [19]

Wray

[11] 4,063,701

[45] Dec. 20, 1977

[54] CHAIR ATTACHED HOLDER

[76] Inventor: Rhodes E. Wray, 1 Wilson Lane, Staunton, Va. 24401

[21] Appl. No.: 663,128

[22] Filed: Mar. 1, 1976

[51] Int. Cl.[2] ..... A47F 5/00

[52] U.S. Cl. ..... 248/293; 248/310; 248/226.1; 297/188

[58] Field of Search ..... 248/310, 311, 314, 315, 248/226 R, 226 A, 289, 206 A, 293, 346.1, 312; 297/188, 189, 191, 194

[56] References Cited

U.S. PATENT DOCUMENTS

| | | | |
|---|---|---|---|
| 984,225 | 2/1911 | Knapp | 248/293 |
| 1,255,720 | 2/1918 | Ekman | 297/189 |
| 1,809,317 | 6/1931 | Snyder | 248/293 |
| 1,892,687 | 1/1933 | Teufel | 248/293 |
| 2,235,986 | 3/1941 | Ellingson | 248/312 |
| 2,457,918 | 1/1949 | Pierce | 248/206 R |
| 2,641,911 | 6/1953 | Raymond et al. | 248/346.1 |
| 3,029,105 | 4/1962 | Junkunc | 297/189 |
| 3,116,046 | 12/1963 | Risdon | 297/188 |

*Primary Examiner*—Robert A. Hafer

*Attorney, Agent, or Firm*—Clarence A. O'Brien; Harvey B. Jacobson

[57] ABSTRACT

A holder particularly adapted for supporting beverage containers from a lawn chair in which a clamp is provided for connecting the holder to the leg of a lawn chair or other equivalent support together with a pivotal bracket having a supporting ring at the outer end thereof. The pivotal bracket is selectively retained in horizontal operative position or pivoted downwardly to a generally vertical collapsed or stored position. The supporting ring or annular member at the outer end of the bracket is provided with a net-type of device suspended therefrom having an open bottom with a perimeter less than the supporting ring, thereby effectively supporting and suspending the lower end portion of a beverage container.

5 Claims, 4 Drawing Figures

CHAIR ATTACHED HOLDER

BACKGROUND OF THE INVENTION

1. Field of the Invention

The present invention generally relates to a support or holder for a beverage container, or the like, specifically adapted to be mounted on the supporting leg of a lawn chair or similar chair in which a clamp is provided for securing the holder in position and the holder is provided with a collapsible bracket and a supporting ring and net so that the device may be selectively oriented in active, generally horizontal position or stored generally vertical position alongside of the lawn chair leg.

2. Description of the Prior Art

When consuming beverages from various types of containers, it is essential that the beverage container be placed in or on a support from time to time. When indoors, coffee tables, cocktail tables, and other similar supports are usually readily available. However, when outdoors, it frequently occurs that a support of this type is not available. For example, if a person is occupying a lawn chair in the yard, it frequently occurs that the only place to set the beverage container is on the grass or other uneven surface, thus frequently resulting in spillage of the beverage due to the container turning over. Prior U.S. Pat. No. 3,317,171 discloses a holder for beverage containers which is attached to an aluminum lawn chair or the like by employing a double-type clamp, that is, one clamp supporting the device on the chair and another clamp securing the container on the holder. Prior U.S. Pat. No. 3,269,683 illustrates another type of holder for beverage containers which is specifically adapted for clamping engagement with a golf cart handle for supporting the beverage container when desired when playing golf. While such devices operate satisfactorily, they are not specifically constructed to conveniently support a beverage container from the front leg of a lawn chair.

SUMMARY OF THE INVENTION

An object of the present invention is to provide a holder for a beverage container adapted to be attached to the leg of a lawn chair or the like in which the holder is collapsible from a position extending generally horizontally for supporting a beverage container to a generally vertical position alongside of the leg of a lawn chair so that the lawn chair may be folded and compactly stacked or stored.

Another object of the invention is to provide a holder in accordance with the preceding object embodying a unique clamp and bracket assembly which enables the bracket to be supported horizontally or vertically.

Yet another object of the invention is to provide a holder for beverage containers in which the container is received within a net attached to an annular member with the net having a bottom edge of less perimeter than the annular member so that the net will support the lower end of a beverage container which has a perimeter smaller than the annular member.

A still further important object of the present invention is to provide a chair attached holder for beverage containers which includes a unique flexible supporting net somewhat similar to a basketball goal net for supporting the lower end of a beverage container with the net being completely collapsible but effective to maintain the beverage container in upright position when the beverage container is inserted downwardly through an annular supporting ring.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
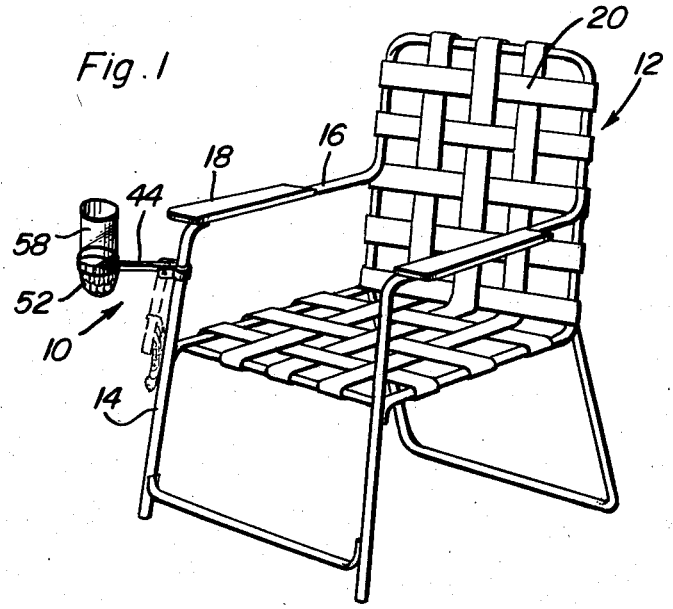
FIG. 1 is a perspective view of the beverage container holder of the present invention illustrating the association of the holder with the leg of a lawn chair.

Referring now specifically to the drawings, the holder of the present invention is generally designated by reference numeral 10 and is illustrated attached to a conventional lawn chair 12 which may be of the folding or stackable type which usually includes a generally vertically disposed or downwardly and forwardly inclined front leg 14 having the usual horizontal arm rest 16 provided with a panel or pad 18. The lawn chair 12 is provided wth the usual webbing 20 and other structural features normally found in this type of chair. The specific construction of the lawn chair itself is conventional and forms no part of the present invention except in its unique relationship to the holder 10.

The holder 10 includes an attaching clamp generally designated by numeral 22, an elongated bracket generally designated by the numeral 24 and a supporting net assembly generally designated by numeral 26. The clamp 22 includes a generally split cylindrical member 28 having a pair of laterally extending, spaced parallel ears or lugs 30 thereon which define a lateral opening into the cylindrical clamp 28 so that it may be positioned on the forward leg 14 of the lawn chair 12 and adjustably secured in position thereon by moving the ears 30 towards each other. The ears 30 include a pair of openings 32 and 34 therethrough, with the openings in the two ears 30 being aligned with each other. Two screws 36 and 38 extend through the respective apertures 32 and 34 with the screws being completely conventional in and of themselves and provided with a head having a slot or kerf therein. Retaining nuts 40 are provided for the screws 36 and 38 and one of the screws 36 includes a spring washer 42 mounted thereon. By tightening the screws, the clamp 22 may be adjustably but fixedly secured in position on the front leg 14 of the lawn chair.

Figure 3:
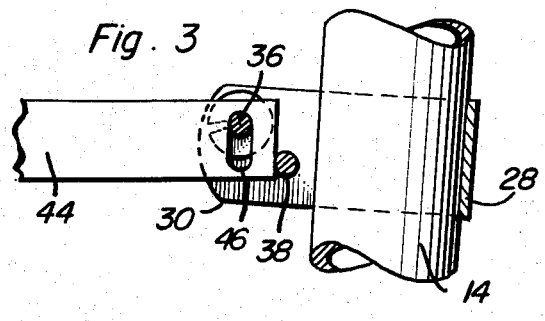
FIG. 3 is a detailed fragmental sectional view of the supporting clamp and bracket when the holder is in operative position.
Figure 4:
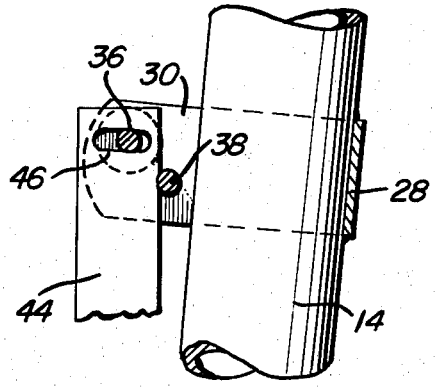
FIG. 4 is a sectional view similar to FIG. 3 with the holder in collapsed or stored position.

The bracket 24 is in the form of an elongated strap or bar 44 having a vertical slot 46 adjacent the end thereof which is disposed at the clamp 22. The slot 46 is parallel to the end edge of the strap 44 and is received on the upper and outer screw 36, as illustrated in FIGS. 3 and 4. This enables a limited vertical movement of the strap 44 so that when the strap 44 is in horizontal position, the screw 36 will be positioned in the upper end of the slot 46 and the screw 38 then will engage the bottom portion of the end edge of the strap 44 as illustrated in FIG. 3, thus retaining the bracket 24 in its operative, generally horizontal position. By moving the strap 44 upwardly so that the screw 36 will be received in the lower portion of the slot 46, the bottom end edge of the strap 44 will pass by the screw 38 so that the bracket 24 may then be pivoted downwardly to a collapsed or stored position, as illustrated in FIG. 4, so that the net assembly as well as the strap 44 will be oriented closely adjacent to and alongside of the front of the leg 14 of the lawn chair.

Figure 2:
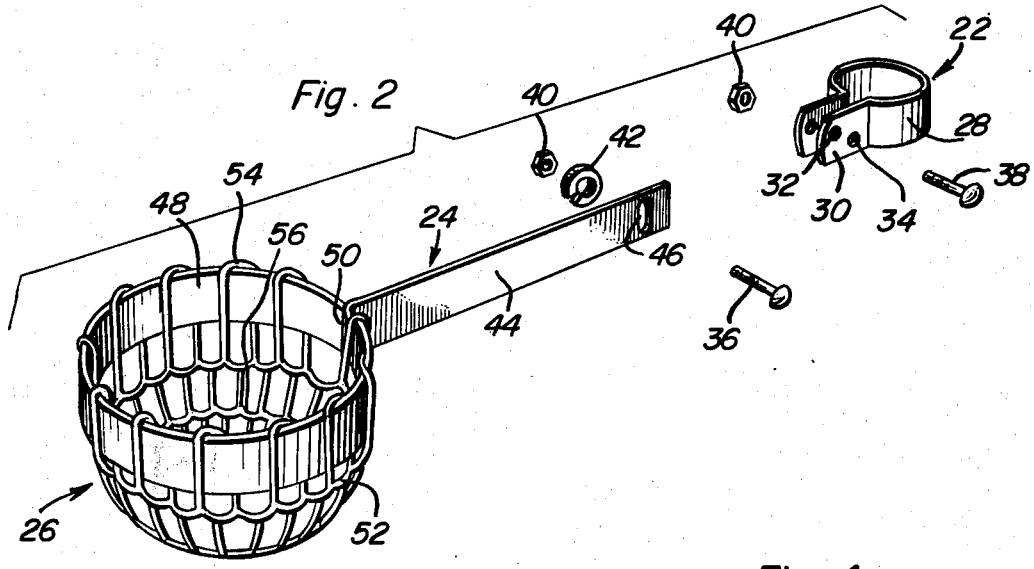
FIG. 2 is an exploded group perspective view of the components of the beverage container holder.

The net assembly 26 includes a ring or annular member 48 formed on the end of the strap 44 as a continuation thereof with the terminal end of the ring 48 as designated by numeral 50 being disposed closely adjacent the strap 44, as illustrated in FIG. 2. Attached to the ring 48 and depending therefrom is a net 52 constructed of mesh material, such as that employed in a basketball goal net, with the upper end of the net 52 including loops 54 received on the ring 48 and the lower end of the net being defined by a lower perimeter defining flexible string 56, or the like, which is of a dimension less than the perimeter of the ring 48. Thus, the lower end of the net has a perimeter substantially less than the perimeter of the ring 48 and, of course, the member 56 as well as the ring 48 general define a circular configuration primarily for supporting beverage containers 58, such as glasses, cans, and the like, from which beverages are consumed. The terminal end 50 of ring 48 may abut or be welded to the strap 44 or have an overlapping connection therewith, if desired.

While the dimensions of the device may, of course, vary, it has been found that the diameter of the ring 48 may conveniently be approximately 3 inches with the net depth being approximately 2 inches and the lower diameter of the net being approximately 1½ inches. The over-all length of the holder may be approximately 7 inches and the clamp diameter may be approximately 1 inch with the flanges or lugs 30 being approximately 3/16 inch apart. The construction of the net is such that various types of devices may be supported conviently in the holder with the supported articles being maintained generally in an upright manner. As long as the diameter of the article being supported is greater than the diameter of the lower flexible member 56 defining the open end of the net, the article will be supported by the holder. This is particularly significant when consuming beverages from containers, such as, glasses, cups, cans, bottles, and the like, since such containers frequently are provided in various sizes.

The bracket may be constructed of aluminum, stainless steel, other corrosion resisting metals, plastics, and the like, and the net may be fabricated from rope, mesh fabric, or similar materials, either natural or manmade. When the bracket is moved to a stored position, it eliminates protrusions or projections on the chair, thus enabling the chair to be stacked or folded in a conventional manner without any obstructions whatsoever. The holder is particularly useful outdoors where the ground surface is usually uneven and usually the only place a beverage container can be placed. It is not only awkward to place a drink on the ground but frequently a spill will result in view of the unevenness of the ground. Also, the drink will be conviently supported in a more accessible position by the holder. The device also is quite useful when a lawn chair, or the like, is placed on the sand at a beach, since the beach sand frequently is uneven and also frequently is quite hot and it is undesirable to have sand on the bottom of the container. Various endeavors may be more effectively accomplished by using the holder, especially those endeavors requiring the use of two hands, such as reading a newspaper, knitting, fishing, or the like. The device has particular adaptability for use on chairs at poolside, on patios, on ship decks, and many other places where it is desired to support a beverage container in a readily aaccessible position with the holder being selectively collapsible to a stored compact condition.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An article holder comprising a supporting bracket, a single elongated arm attached to said bracket and projecting generally horizontally therefrom, an annular member on the outer end of said arm, and a net of mesh material supported from and depending from said annular member, said net including an open bottom end defined by a flexible member with the open bottom being larger than the interstices in the net and having a perimeter less than the perimeter of said annular member for supporting articles inserted downwardly through the annular member when such articles have a perimeter greater than the open bottom end of the net, said bracket being in the form of a clamp, and means pivotally connecting the arm to the clamp to enable the arm, annular member and net to be pivoted to a collapsed generally vertical stored position, said means including a vertical slot in the end of the arm, a flange on said clamp, said flange including a pivot pin means extending through the slot, and cooperating abutment means associated with the flange and arm to retain the arm horizontal when the pin means is in the upper end of the slot and permit the arm to swing downwardly when the arm is moved upwardly to disengage the abutment means.

2. A holder for a beverage container or the lke for attachment to the front leg of a lawn chair, comprising a clamp adapted to be attached to the front leg of a chair, a bracket attached to the clamp and projecting therefrom, a net assembly at the outer end of the bracket for supportingly receiving a beverage container, said net assembly including an annular ring rigid with the bracket, a depending mesh member of flexible material attached to the ring, the lower end of the mesh material being open and provided with a perimeter less than the perimeter of the ring for supporting beverage containers telescopically inserted downwardly through the ring, said clamp including a pair of projecting lugs thereon, said bracket being in the form of a rigid strap having one end projecting between the lugs, the end of the strap including a vertically elongated slot, a pair of spaced fasteners extending through the lugs in vertically and horizontally spaced relation with the outermost and uppermost fastener extending through the slot with the lowermost and innermost fastener engaging the lower end edge portion of the strap when the outer and upper fastener is received in the upper end of the slot, whereby upward movement of the strap will raise the lower corner of the end edge of the strap above the lower and inner fastener thereby enabling the strap to pivot downwardly about the upper and outer fastener to a substantially vertical position alongside of the front leg of a lawn chair.

3. The structure as defined in claim 2, wherein said clamp is in the form of a split cylindrical member with the laterally extending lugs defining an entrance area into the clamp to enable it to be mounted on the front leg of a lawn chair, said fasteners being in the form of screw threaded members and nuts for clamping the clamp onto the leg of a lawn chair and enabling assembly and disassembly of the holder.

4. The structure as defined in claim 3, wherein the upper and outer fastener includes a spring washer thereon to maintain resilient tension against the lugs and strap to retain them frictionally in adjusted position.

5. The structure as defined in claim 4, wherein said annular ring is in the form of a continuation of the strap formed into a substantially cylindrical configuration with the terminal end of the strap in close proximity to the remaining portion of the strap to form a closed ring, said flexible mesh member including a plurality of loops at the upper end thereof disposed on said ring and suspending the mesh material therefrom.

* * * * *